United States Patent [19]

Nijman et al.

[11] 3,952,392

[45] Apr. 27, 1976

[54] FIELD TERMINATION TOOL HAVING CONNECTOR REFERENCE PLANE APPARATUS AND HINGED INSERTION ARMS

[75] Inventors: John Peter Nijman, West Hill; Terence Neil Patterson, Toronto, both of Canada

[73] Assignee: Bunker Ramo Corporation, Oak Brook, Ill.

[22] Filed: Jan. 11, 1974

[21] Appl. No.: 432,484

[52] U.S. Cl. ..... 29/203 MW; 29/203 DT; 29/203 HT

[51] Int. Cl.[2] ..... H01R 43/04

[58] Field of Search... 29/203 HT, 203 MW, 203 H, 29/203 P, 203 DT, 203 J, 628; 7/14.1 R

[56] References Cited

UNITED STATES PATENTS

| | | | |
|---|---|---|---|
| 3,665,574 | 5/1972 | Brown et al. | 29/203 MW |
| 3,742,571 | 7/1973 | Brehm | 29/203 HT |
| 3,758,935 | 9/1973 | Long et al. | 29/203 MW |
| 3,800,390 | 4/1974 | Johnston | 29/203 P |
| 3,816,897 | 6/1974 | Long | 29/203 MW |
| 3,819,104 | 6/1974 | Lang | 29/203 MW |

*Primary Examiner*—Carl E. Hall
*Attorney, Agent, or Firm*—William Lohff; F. M. Arbuckle

[57] ABSTRACT

A field termination tool for electrical connectors includes laterally floating combs having edges which engage respective longitudinal slots on each side of an electrical connector to define a reference plane, the connector being urged toward the reference plane by a wave or blade spring carried on the connector support. The insertion tool is constructed to force insulated conductors into respective insulation piercing portions of connector contacts equally well for different connector widths by apparatus for positioning one of a pair of oppositely directed rotatable insertion arms with respect to the other and to the connector support and by providing a floating support structure to equalize forces across a connector. The comb slots each have a cutting edge which is cooperable in a scissor action with the cutting edges of the insertion blades carried on the insertion arms to sever the conductors immediately prior to insertion. The insertion arms are forced perpendicular to their planes of rotation to prevent parting of the cutting edges during the cutting operation.

20 Claims, 10 Drawing Figures

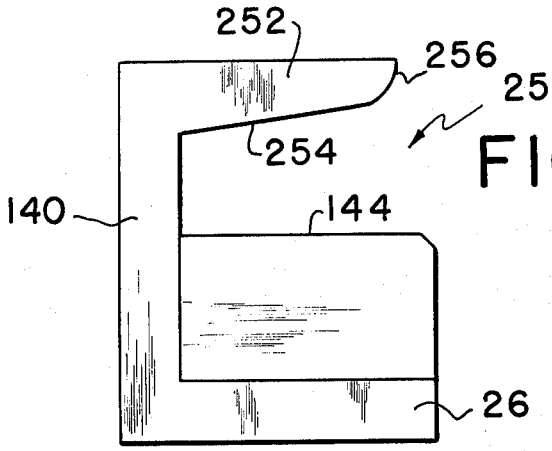
FIG. 8
FIG. 10
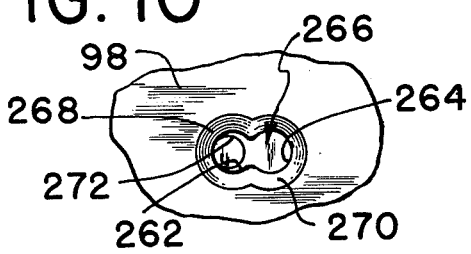
FIG. 9
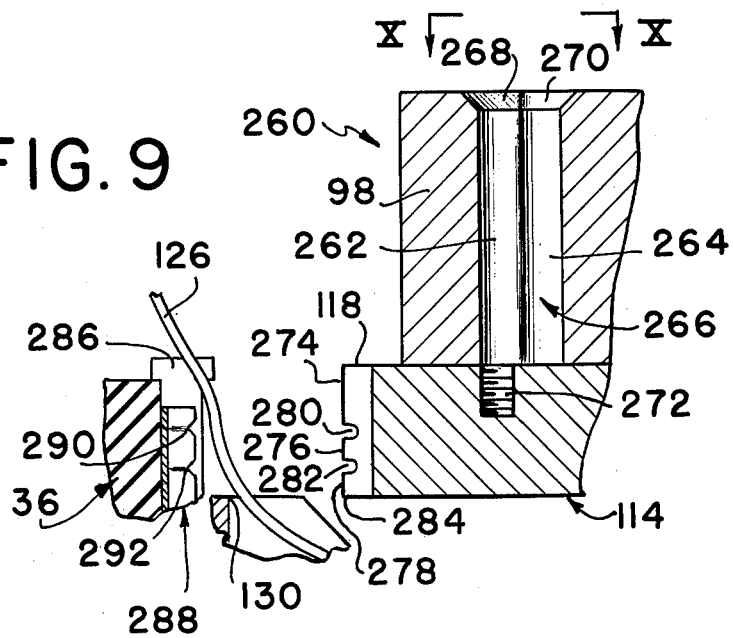

FIELD TERMINATION TOOL HAVING CONNECTOR REFERENCE PLANE APPARATUS AND HINGED INSERTION ARMS

BACKGROUND OF THE INVENTION

1. Field of the Invention

This invention relates to apparatus for terminating a plurality of insulated conductors in respective insulation-piercing contact portions of electrical connectors, and more particularly to such apparatus which comprises structure for establishing a reference plane through an electrical connector to be terminated and structure for inserting conductors into insulation-piercing contact equally well for different widths of connectors.

2. Description of the Prior Art

Generally speaking, termination tools for inserting insulated conductors into insulation-piercing portions of electrical contacts mounted in electrical connectors provide a connector support structure with apparatus for releasably engaging the connector in a semipermanent fixed relationship. Although this technique provides satisfactory termination in most instances, it has been determined that the actual dimensions of connectors vary from one connector to the next, e.g. connector transverse sectional height, due to manufacturing tolerances, and these tolerances cannot be tightened, for economic reasons, particularly when one is concerned with miniature connectors.

For any given line of connectors, the female connector may be narrower at the rear or termination end than the corresponding male connector. For example, in a particular line of connectors, the male connector is 0.80 inches wider than the corresponding female connector in the transverse direction at the termination end. It is therefore readily apparent that the depth of penetration of the female connector will be less than that of the male connector, which may cause improper or incomplete termination.

SUMMARY OF THE INVENTION

The primary object of the present invention is to provide a new and improved termination apparatus, particularly field termination apparatus, for terminating a plurality of free-ended insulated conductors in respective insulation-piercing portions of contacts of an electrical connector.

A more specific object of the invention is to provide termination apparatus which establishes a reference plane through an electrical connector immediately adjacent the insulating-piercing portions of the contacts of the connector.

Another object of the invention is to provide termination apparatus for terminating electrical connectors having different transverse widths.

Another object of the invention is to provide termination apparatus which includes a floating connector support for equalizing forces applied across a connector by oppositely directed insertion members.

According to the invention, an electrical connector is mounted against an end stop to define a cooperable relationship between the insulation-piercing contact portions thereof and insertion members which are rotatable toward the connector to engage and press insulated conductors into respective ones of the insulation-piercing contact portions. The general structure of an electrical connector which may be terminated by apparatus constructed in accordance with the invention includes a longitudinally extending slot on opposite sides thereof. The connector support includes a wave or blade spring for urging the connector upwardly and a pair of members, here in the form of conductor separation and cutting combs, include respective downwardly extending edges for extending into the respective longitudinal slots to engage the connector and define a reference plane therethrough immediately adjacent the insulation-piercing contact portions of the connector.

The conductor separation and cutting combs are movable transversely of the connector under the control of a lever arrangement so that a connector may be received upon and removed from the connector support. As will become apparent from the following description, the conductor separation and cutting combs are resiliently mounted to provide a floating feature for the connector support for effecting equalization of forces across the connector during conductor insertion.

Insertion of the insulated conductors into the insulation-piercing portions of the connector contacts is provided by a pair of multi-blade insertion members which are carried on rotatably mounted arms for pivoting toward opposite sides of the electrical connector. The lower edges of the individual insertion blades constitute cutting edges which cooperate with the rear edges of the comb slots to sever the individual conductors immediately prior to insertion thereof into the insulation-piercing portions of the contacts. This sequential cutting and insertion operation provides a simple technique for cutting all of the conductors and a reduction of forces necessary in terminating the conductors. As the insertion members engage the connector, the insertion forces across the connector are equalized by the floating arrangement of the resiliently mounted combs.

In order to provide for equally satisfactory insertion in connectors of different widths, one of the rotatable insertion arms remains "fixed" with respect to its relation to the connector support structure, while means are provided for moving the other insertion arm toward and away from the connector support structure depending on the width of connector to be terminated, i.e. male or female connector. In two embodiments of the invention the connector support and one of the insertion arms are moved with respect to the other insertion arm. In a first of these embodiments, this is accomplished by rotating a threaded rod to draw or push, as the case may be, the aforementioned apparatus toward and away from each other along a set of guide rails. In a second embodiment this movement is accomplished, again along the guide rails, by rotating a rod which carries a cam that is cooperable with a cam follower carried by the fixed portion of the structure. In a third embodiment of the invention, the axis of rotation of one insertion arm is moved transversely with respect to the remainder of the termination apparatus. In this embodiment of the invention, means are provided for changing the resulting slight angle of incidence of the insertion blades carried by the arm so that insertion remains in a direction perpendicular to the connector and penetration is equal for all of the blades.

It has been determined that when a plurality of conductors are severed by a cooperable insertion blade-comb combination as the insertion blades are pivoted into engagement with the conductors, the insertion blades have a tendency to ride-up and over the combs, resulting in incomplete and/or ragged cutting of the conductors. Therefore, means are provided for urging the insertion arms downwardly during the cutting operation. This means includes a spring loaded ball which rides against the upper face of a cutting arm near its axis of rotation, and an angularly mounted stud for engaging a similarly inclined surface of a toggle arm carried at the distal end of the insertion arm for urging the distal end of the insertion arm downwardly as the toggle arm engages and cams about the angularly mounted stud.

BRIEF DESCRIPTION OF THE DRAWINGS

The above and other objects, features and advantages of the invention will become apparent from the following detailed description of the invention taken in conjunction with the accompanying drawings, on which:

FIG. 8 is an end view of structure for forcing the distal end of an insertion arm downwardly to promote even severing of the conductors;

FIG. 9 is a sectional view taken along line IX—IX of FIG. 1 showing preferred apparatus for adapting the termination apparatus for different sizes of connectors; and FIG. 10 is a plan view taken along the line X—X of FIG. 9.

DESCRIPTION OF THE PREFERRED EMBODIMENTS

Figure 1:
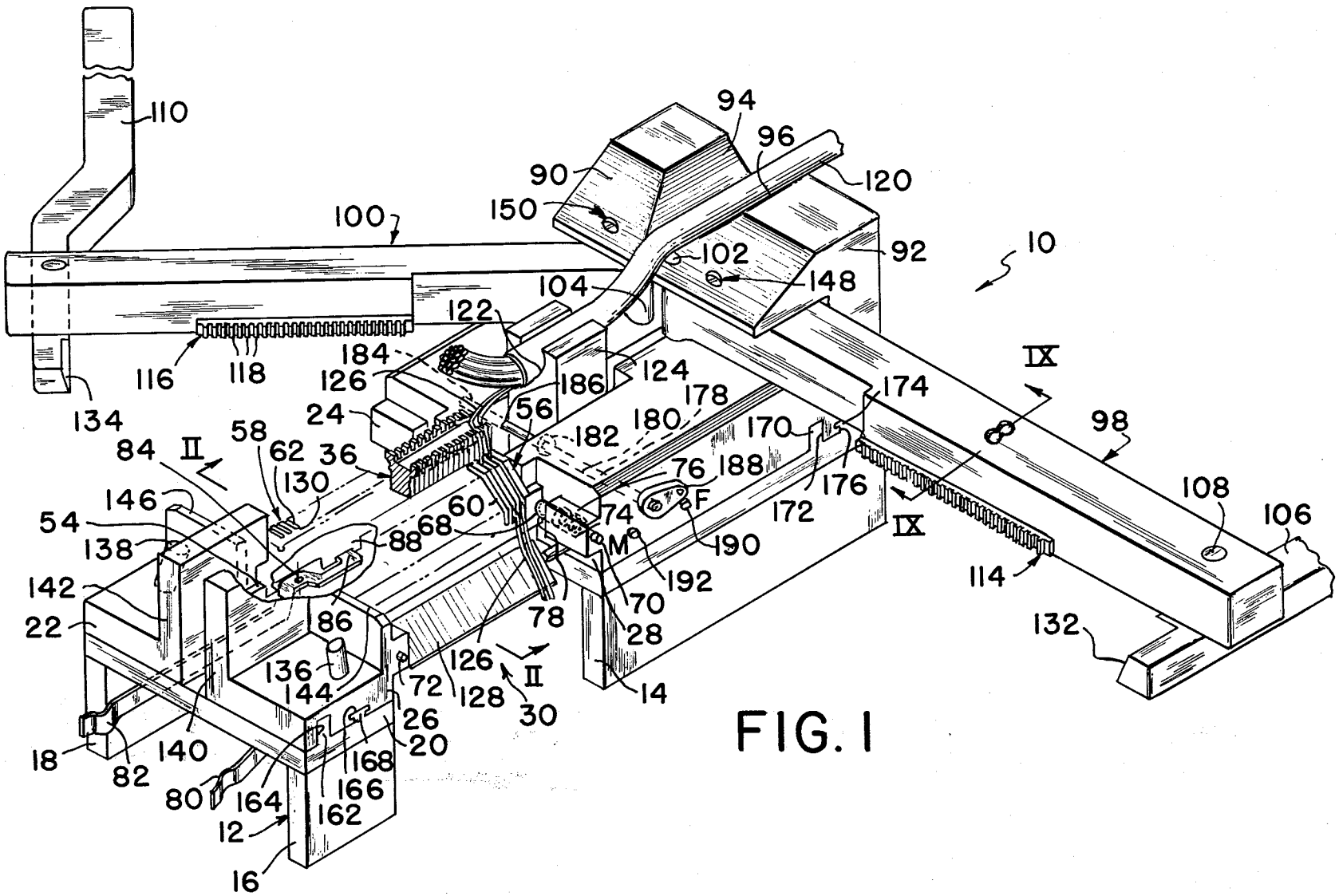
FIG. 1 is a pictorial representation of an embodiment of the invention.

Referring to FIG. 1, a terminating apparatus is generally illustrated at 10 as comprising a frame 12 which includes downwardly extending rear legs 14 (only one shown), a pair of downwardly extending front legs 16 and 18, and a horizontal table member 20 carried by the legs 14, 16 and 18.

A pair of base members 22 and 24 on the left hand side of the apparatus are fixed to the table member 20, and may be either a two-piece or one-piece construction. On the right hand side of the apparatus is a base 26 and a base 28 which may advantageously be a one-piece structure, in that they are constructed to move together laterally of the apparatus 10, as will be described below.

Figure 2:
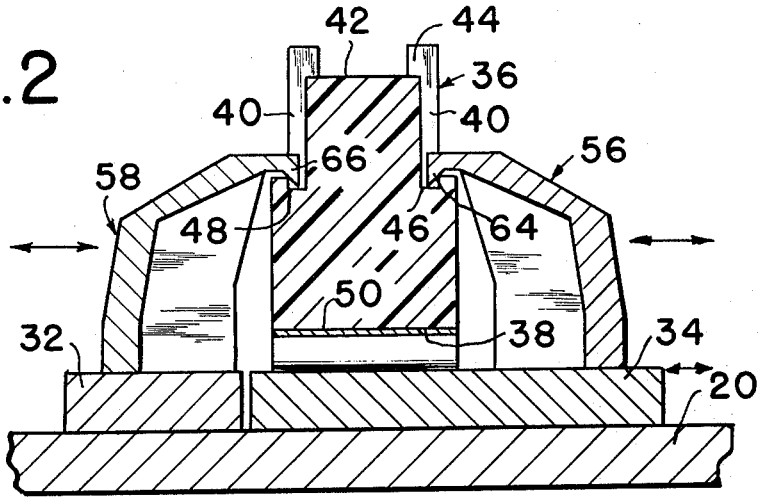
FIG. 2 is a sectional view of a portion of the apparatus of FIG. 1 taken generally along the parting line II—II.
Figure 3:
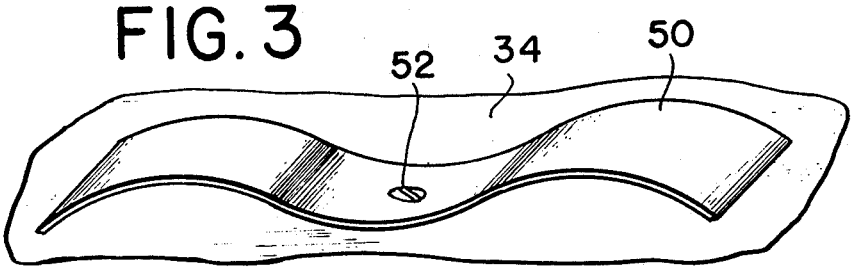
FIG. 3 is a view of the connector support spring structure for the apparatus illustrated in FIG. 1.

In a recessed area 30, the bases 22, 24 and 26, 28 include respective portions 32 and 34 which are carried on the table member 20 (FIG. 2). An electrical connector 36 is carried on the base portion 34 and includes a forward end 38, a plurality of contact carrying slots 40 in parallel rows on each side of the connector, a longitudinal slot 42 along the rear end of the connector and a plurality of slots 44 which communicate the slots 40 with the slots 42. The connector 36 also includes a pair of longitudinally extending slots 46 and 48 on respective sides thereof immediately adjacent the insulation piercing portions (not shown) of the contacts of the connector 36. A wave or blade spring 50 is mounted on the base portion 34 by means of a screw 52 to engage the forward end 38 of the connector 36 and urge the connector in the upward direction.

An end stop 54 (FIG. 1) is provided to receive an end of the connector 36 in abutting contact. A pair of conductor combs 56 and 58 are resiliently mounted on each side of the connector support structure and include respective downwardly extending edges 64 and 66 for extending into the respective slots 46 and 48 and contacting the connector against the bias provided by the blade spring 50. As the connector 36 is urged upwardly against the edges 64 and 66, a reference plane is established immediately adjacent the insulation-piercing portions of the contacts of the connector.

The comb 56 is provided with a plurality of slots 60 and the comb 58 is provided with a plurality of slots 62 for receiving individual conductors 126 of a cable 120 after the same have been dressed through the connector slots 44 and draped through the slots 60 and 62.

Referring to the right hand side of the apparatus illustrated in FIG. 1, each of the combs includes an aperture 68 for receiving and sliding axially along a pin 70, a pin 72 being the only other such pin shown, and is biased toward the connector by a spring 74 disposed in a counterbore 76 and pressing against a cylindrical bushing 78 which bears against the comb, the pin 70 extending through the bushing 78 and the spring 74.

In order to open the combs so that a connector may be placed upon the blade spring 50, a pair of hand-operated levers 80 and 82 are provided and pivotally mounted, as indicated at 84, so as to push the combs outwardly against the bias of the spring 74 by movement of the end 86 of the lever against a portion 88 of the comb as the outer ends of the levers 80 and 82 are moved toward each other. With the connector positioned against the end stop 54 and urged upwardly by the spring 50, the levers 80 and 82 are operated so as to permit the springs 74 to return the combs toward each other so that the downwardly extending edges 64 and 66 snap into the slots 46 and 48, respectively.

The cable 120 is supported at the rear by a pair of upstanding portions 90 and 92 having respective downwardly and inwardly directed surfaces 94 and 96 which form a V-shaped cable support, and by a rounded slot 122 in an upstanding block 124.

A pair of insertion arms 98 and 100 are rotatably mounted to the upstanding portions 92 and 90 at respective pivots 102 and 104. A toggle arm 106 is rotatably mounted to the insertion arm 98 by a pin 108 and a toggle arm 110 is rotatably mounted at a pin 112 to the insertion arm 100. The insertion arm 98 carries a multi-blade insertion member 114, which is connected from below by screws or the like, and the insertion arm 100 carries a multi-blade insertion member 116 of similar construction. The individual blades have been referenced 118 and, as mentioned above, have sharp lower edges (284, FIG. 9) to cooperate with the sharp edges 130 of the comb slots for severing the individual conductors 126 immediately prior to insertion. A conductor dressing schedule 128, in the form of a color code chart or the like, may be mounted adjacent the combs 56 and 58 to great advantage.

After the connector has been mounted and provided a reference plane as described above, the individual conductors 126 may be dressed through the connector slots 44 and the comb slots 60, 62 in accordance with the coding provided by the schedule 128. The connector is then ready for termination.

Figure 4:
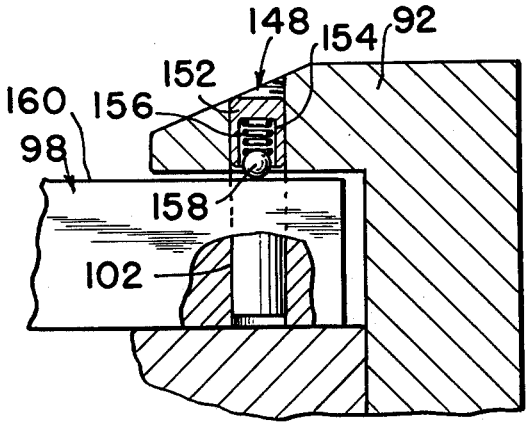
FIG. 4 is a sectional view taken generally along the line IV—IV of FIG. 1.
Figure 5:
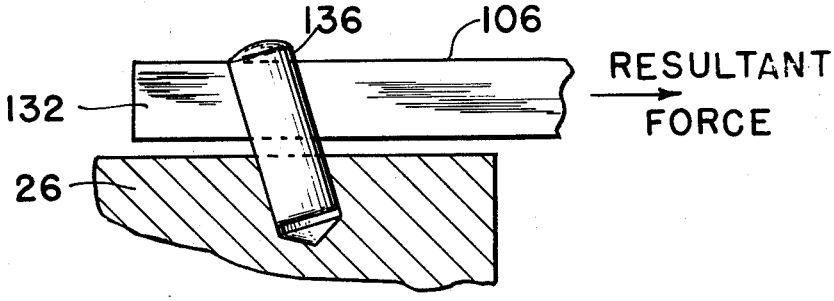
FIG. 5 is an illustration of the relationship between the angularly mounted stud and the toggle arm of the apparatus illustrated in FIG. 1.

To sever the conductors at the proper length and to insert the same into the insulation-piercing contact portions of the connector 36, the insertion arms 98 and 100 are rotated toward each other about their respective pivots 102 and 104 to place the insertion members 114 and 116 adjacent the conductors 126. As the insertion arms 98 and 100 are rotated, a pair of spring loaded mechanisms 148 and 150, respectively, press down on the upper faces of the arms, as can be seen in greater detail in FIG. 4. The spring loaded mechanism 148 in FIG. 4 includes a threaded cap 152 having a bore 154 therein for receiving a spring 156 which urges a ball 158 against the upper surface 160 of the arm 98. In FIG. 4, the pivot pin 102 is shown directly behind the spring loaded mechanism 148.

At the other ends of the insertion arms 98 and 100, the toggle arms 106 and 110 are provided with respective angled surfaces 132 and 134 which engage and cam about respective angularly extending studs 136 and 138 carried by the base members 26 and 22, respectively. In one construction, the angle of a stud with respect to its base member was from 10° to 15°. With this toggle and camming structure, the distal ends of the arms 98 and 100 are pressed downwardly as the toggle arms 106 and 110 are rotated toward each other and cam about the studs 136 and 138 which also act as fulcrums, the lever loads being effective as the pivot points of the toggle arms and the insertion arms, e.g. the pin 108.

The spring loaded mechanisms 148 and 150 and the toggle-cam constructions, prevent the insertion members from riding up during the cutting operation so that clean, complete and even cutting of the conductors is accomplished.

As the arms 98 and 100 are rotated toward the insertion position and are forced downwardly by the cam-toggle mechanism, they ride along respective upstanding edges 144 and 146 of the bases 26 and 22. The bases 22 and 26 also include upstanding portions 142 and 140, respectively, which serve as stops for the arms 100 and 98, respectively, to indicate completion of the insertion operation.

As the blades 118 of the insertion members 114 and 116 engage the connector 36 via the individual conductors, forces are created transversely of the connector. With the combs 56 and 58 floating, i.e. movable along the pins 70 and 72, forces are equalized across the connector and equal insertion is provided for all of the conductors.

Referring in particular to FIG. 1, the table member 20 is provided with an upstanding guide rail 162 which is received in a complementary slot 164 in the base 26, and an upstanding T-shaped rail 166 which is received in a complementary T-shaped slot 168 in the base 26. Likewise, at the rear of the apparatus, an upstanding rail 170 is received in a complementary slot 172 of the base 28 and an upstanding T-shaped rail 174 is received in a complementary T-shaped slot 176 in the base 28. This rail and slot structure provides a controlled even movement of the base 26, the base 28, the base portion 34, and all of the apparatus carried thereon on the right hand side of the apparatus, with respect to similar structure which is fixed to the table member 20 on the opposite side of the apparatus. In FIG. 2, for example, the base portion 34 is movable along the table member 20, as indicated by the double headed arrow next to that base portion, while the corresponding base portion 32 is fixed with respect to the table member 20. Positioning of the apparatus on the right hand side of the machine, including the supported connector, with respect to the apparatus on the left hand side of the machine provides for proper and complete insertion of conductors into connectors having different transverse widths in the area of their rear or termination portions. For example, as previously mentioned, a male connector and a corresponding female connector generally have different widths in this area, amounting to several tens of thousandths of inches. Several mechanisms are available in the art for moving one of the structures with respect to the other. The mechanism illustrated herein employs a rod 178 which extends through a bore 180 and is rotatably secured in the base 28 by a bearing 182 fixed to the base 28, and a threaded end 184 of the rod 178 which engages a threaded bore 186 in the base 24. Conversely, the bore 180 may be a threaded structure and the left hand end of the rod may be fixed for rotation in the base 24, in either case, rotation of a lever 188 against the stop 190 positions the structures closer together for a female connector, indicated by the F, and rotation of the shaft 178 by 180° where the lever 188 is positioned against stop 192, spreads the structures apart for the wider male connector, indicated by the M reference.

Figure 6:
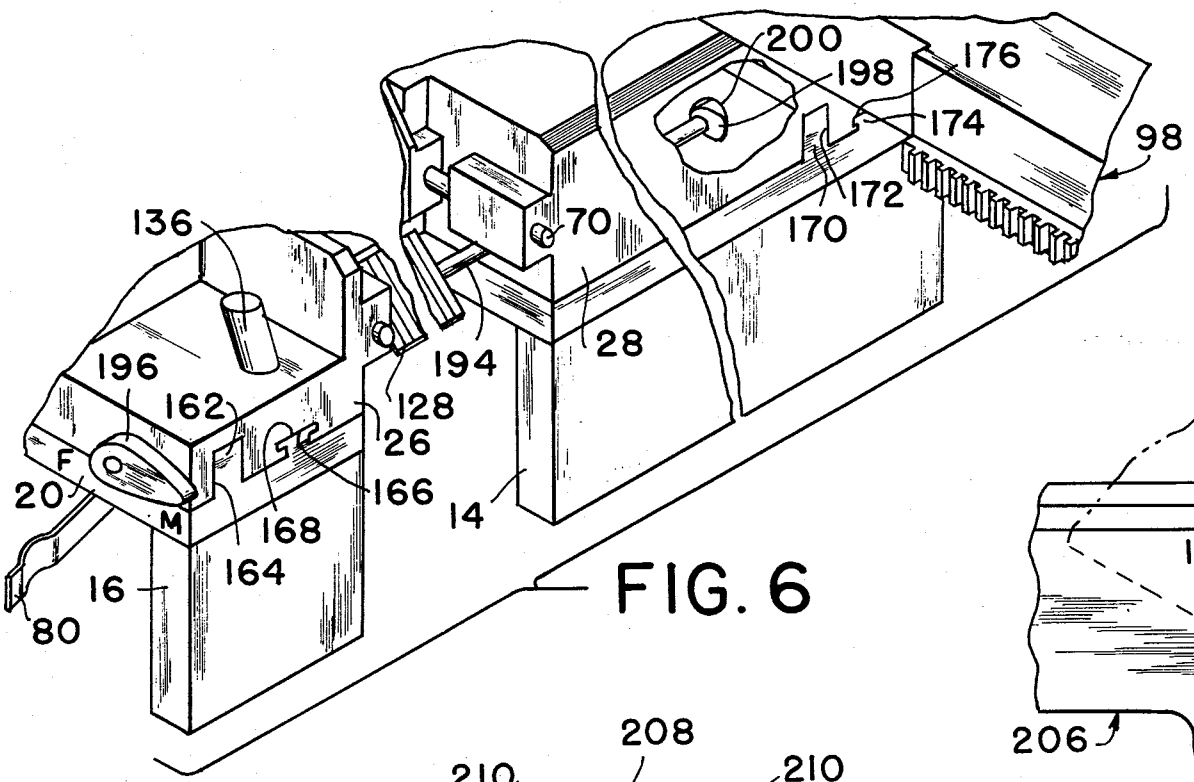
FIG. 6 is a pictorial representation of apparatus similar to that shown in FIG. 1, but having a different mechanism for moving the connector support with respect to one of the insertion arms.

Referring to FIG. 6, the same general structure for accommodating different widths of connectors, is illustrated with a different mechanism for positioning the bases 26 and 28 with respect to the bases 22 and 24. A rod 194 extends longitudinally through the apparatus through bores (not shown) and carries a lever or handle 196 at the forward end of the apparatus to point toward respective references M and F to indicate male and female settings. Toward the rear end of the apparatus, in the area of the rail 170, the rod 194 is provided with a cam 198 which rotates in a hollow cam follower 200. With the cam 198 fixedly associated with the bases 26 and 28 and the cam follower fixedly associated with the table member 20, the upper structure is moved transversely of the termination apparatus with respect to the lower structure. Therefore, the insertion arm 98 and the cam stud 136 are both moved the same amount with respect to the opposite side of the termination apparatus, as was the case with the structure illustrated in FIG. 1.

Figure 7:
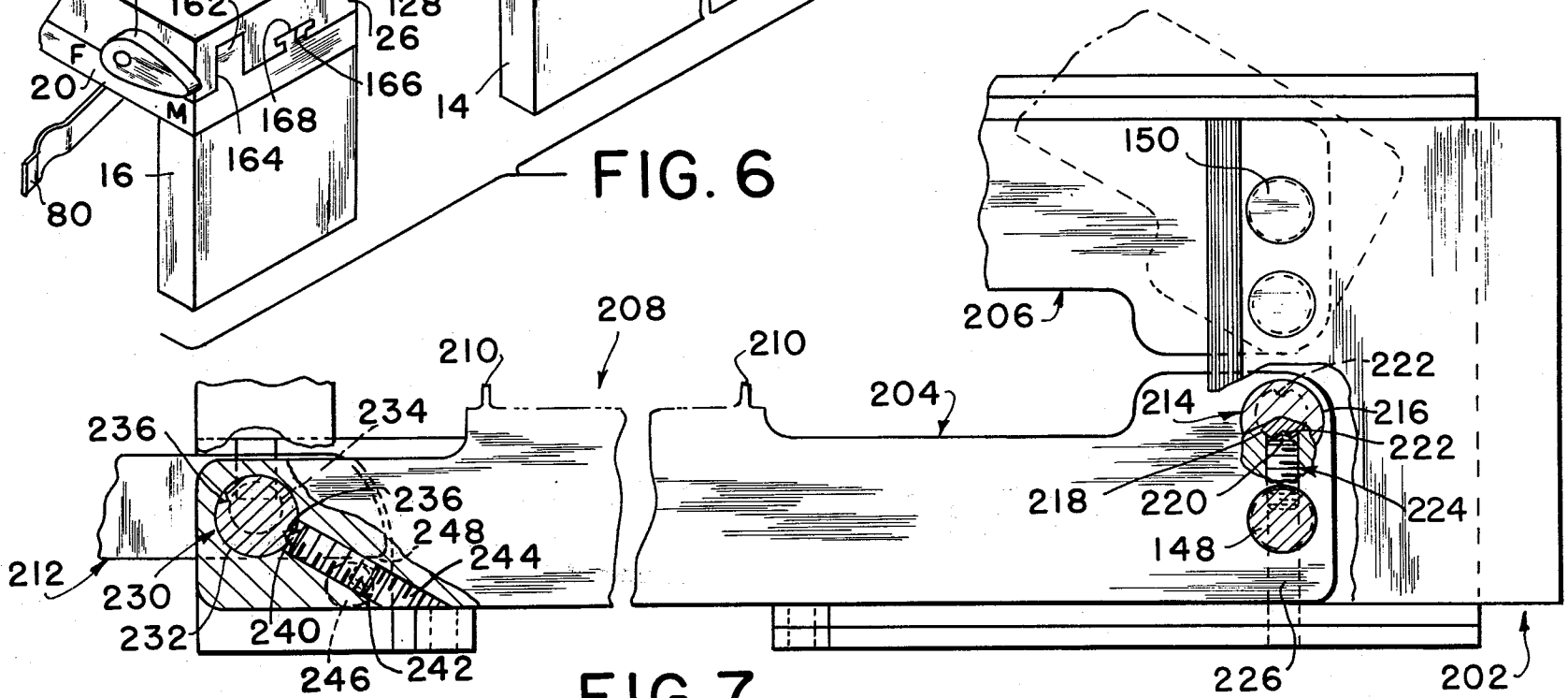
FIG. 7 is a plan view of a portion of a terminating apparatus similar to that illustrated in FIG. 1, but showing a further mechanism for displacing an insertion arm relative the connector support structure.

Referring to FIG. 7, a different mechanism for repositioning one of the insertion arms with respect to the other insertion arm is illustrated for apparatus generally the same as that shown in FIGS. 1 and 6. In FIG. 7, the front of the apparatus is at the left hand side of the drawing and the rear of the apparatus is at the right hand side of the drawing. An upstanding and overhanging hood type structure, without a V-shaped cable support is illustrated at 202 for rotatably mounting a pair of insertion arms 204 and 206. Only the insertion arm 204 has been completely illustrated and is shown as comprising an insertion member 208 having a plurality of insertion blades 210. A toggle arm 212 is pivotally mounted at the distal end of the insertion arm 204 by means of a mechanism which will be explained herein-after in detail.

Referring now, however, to the axis of rotation of the insertion arm 204, a circular eccentric structure 214 includes axially misaligned cylindrical portions 216 (mounted in the arm 204) and 218 (mounted in the base below the arm 204). The cylindrical portion 218 includes a pair of diametrically opposed notches 222 for receiving a ball 220 which is spring loaded by a spring and cap assembly 224 loaded in a bore 226. Rotation of the eccentric with a tool, such as a screwdriver, in a slot on the top end of the eccentric (not shown) moves the axis of rotation of the arm 204 toward and away from the arm 206.

In this embodiment of the invention, the connector support is fixed and does not move transversely with the arm 204 as was the case in the previous embodiments of the invention. Therefore, as the axis of rotation of the arm moves toward and away from the center of the termination apparatus, the angle of incidence of the individual insertion blades 210 changes with respect to the connector. To compensate for this angular disposition with respect to the connector, correct and complete insertion of all conductors along the sides of the connector is provided through an eccentric mounting of the toggle arm 212. This eccentric 230 includes a pair of cylindrical axially misaligned portions 232 and 234, the portion 232 being disposed in the arm 204 and the portion 234 being disposed in the arm 212. A similar screwdriver adjustment is provided for operating this mechanism. The cylindrical portion 232 is provided with a pair of notches 236 located in the periphery thereof at diametrically opposed positions to receive a ball 240 which is spring loaded by a spring loaded cap screw 242 disposed in a threaded bore 244. In addition, the connector support structure, including the resiliently mounted combs, provides for equilization of insertion forces.

Proper positioning of the eccentrics 214, 230 results in audible "clicks" as the balls 220 and 240 are urged into the respective notches 222 and 236 thereby providing a positive indication of correct positioning.

The toggle arm 212 is provided with an angled surface 248 to engage an angularly disposed pin 246, cf. 132, 136 FIG. 1, to provide a downward force on the distal end of the insertion arm 204 during the cutting and insertion operations and, in connection with the eccentric mechanism 230, effects equal penetration of all insertion blades.

Referring now to FIG. 8, a simplified structure for forcing the distal end of the insertion arm downwardly is illustrated at 250 wherein the upstanding portion 140 of the base 26, which functions as an arm stop, is provided with an overhanging portion 252 having a downwardly angled lower surface 254. As the insertion arm traverses the upstanding edge 144, and engages the surface 254, it is urged downwardly to prevent a lifting of the arm and uneven cutting of the conductors. A rounded surface 256 which develops into the surface 254 may be provided to guide the insertion arm.

Referring now to FIGS. 9 and 10, the structure of the insertion blades is illustrated in greater detail along with a simplified structure for positioning the insertion blades relative a connector to adapt the termination apparatus to connectors of different widths. In this embodiment of the invention, as with the embodiment illustrated in FIG. 7, and with the exceptions of the floating connector support structure and the rotatable insertion arm structure, the entire insertion apparatus is a fixed structure.

The adjustment mechanism is generally illustrated in FIG. 9 at 260 as comprising a pair of parallel bores 262 and 264 which extend vertically through the insertion arm 98 and communicate with each other by way of a common milled out portion 266 to form a slot having a general cross section of a figure eight. The bores have respective countersunk portions 268 and 270 for receiving a complementary shaped head portion of a screw, for example an Allen head screw (not shown). The screw extends through one of the bores 262, 264 and into a threaded bore 272 of the insertion member 114.

In the position illustrated in FIG. 9, the insertion member 114 is adjusted for deeper penetration, i.e. a narrower connector. In the examples given above, this adjustment would be for use with a female connector. To adjust the termination apparatus for use with a wider connector, i.e. a male connector, the screw is loosened so that the conical portion thereof clears the countersunk portion 268, the screw and insertion member are moved toward the right, and the screw is then tightened against the countersunk portion 270 of the bore 264 and is thus provided with a self centering feature.

The insertion member 114 is illustrated as comprising at least one insertion blade 118 which, in turn, comprises a first insertion portion 274, a second insertion portion 276, and a third insertion portion 278, and a pair of intermediate notches 280 and 282. The insertion portions and notches are shown positioned directly across from a conductor 126 and a connector channel 286 having an insulation piercing portion 288 of a contact mounted therein. The contact portion 288 illustrated in FIG. 9 is representative of the types of insulation piercing contacts used in a variety of connectors and comprises a pair of inwardly lanced sections 290 and 292 which have opposing corresponding lanced sections (not shown) which receive the conductor therebetween and cut the insulation thereof to provide electrical and mechanical termination. The notches 280 and 282 are aligned with the lanced sections 290 and 292, respectively, while the insertion portions 274, 276 and 278 extend to completely insert the conductor against the bottom 294 of the contact portion 288. The insertion portion 274 may also be utilized for forcing the cable end of the conductor into the channel 286 for additional strain relief of the conductor.

A cutting edge 130 of a comb is also illustrated in FIG. 9 as being aligned with the lower edge 284 of the insertion blade 118. As set forth above, the lower edge 284 cooperates with the sharp edge 130 to sever the conductor immediately prior to insertion.

It is readily apparent from the foregoing that the objects of this invention have been fulfilled by a variety of embodiments. The embodiment illustrated in FIG. 7 is generally preferred over that illustrated in FIGS. 1 and 6 in that it requires less machining and milling operations than are necessary in providing the guide rails and complementary slots in an accurate and spaced relationship. By the same token, the adjustment mechanism of FIG. 10 also enjoys a fixed base structure and is preferred over the embodiment illustrated in FIG. 7 for several reasons including the necessity of a single adjustment mechanism, the necessity for fewer parts in the adjustment mechanism, and greater simplicity in the mechanism in general.

The embodiments of the invention detailed with respect to FIGS. 1, 6, 7, 9 and 10 have been illustrated as being adjustable between two positions for use in particular with respect to male and female connectors; however, several relative positions of the insertion arms or insertion blades and the connector support may be provided to accommodate a variety of connector widths through the utilization of a plurality of stops, for example detent stops, a series of communicating insertion arm holes, etc.

Although we have described our invention by reference to particular embodiments thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

What we claim is:

1. Apparatus for terminating a plurality of free-ended insulated electrical conductors in respective contact portions of contacts mounted in an electrical connector, comprising:

connector support means for supporting an electrical connector;

a pair of cutting members on opposite sides of said connector support means, each of said cutting members having a cutting edge;

a pair of arms mounted for movement toward respective sides of the supported connector, each of said arms carrying a plurality of insertion blades for engaging and pressing individual conductors into respective contact portions, each of said insertion blades including a cutting edge which is cooperable with a cutting edge of a respective cutting member to sever a corresponding conductor immediately prior to insertion into the respective contact portions; and means urging said arms perpendicularly with respect to their directions of movement to urge said cutting edges of said insertion blades toward said cutting edges of said cutting members.

2. Apparatus according to claim 1, wherein each of said arms is mounted for rotation and the last-mentioned means comprises a pair of spring means mounted adjacent the axes of rotation of said arms to bear against the respective arms.

3. Apparatus according to claim 2, wherein each of said arms is mounted for rotation, and the last-mentioned means comprises a pair of fixedly mounted cam means, and a pair of cam surfaces mounted at the distal ends of respective insertion arms to engage said cam means and urge said distal ends of said insertion arms perpendicular to the planes of rotation of said insertion arms.

4. Apparatus according to claim 2, wherein each of said arms is mounted for rotation, and the last-mentioned means comprises a pair of fixedly mounted cam means engaged by respective insertion arms to urge the distal ends of said insertion arms perpendicular to the planes of rotation of said insertion arms.

5. Apparatus for terminating a plurality of free-ended insulated conductors in respective insulation-piercing portions of contacts mounted on opposite sides of the rear portion of an electrical connector, comprising:

a frame including at least one pair of spaced, transversely extending guide rails;

a first sub-frame carried on said frame in a fixed relation;

a second sub-frame including guide rail receiving means receiving said guide rails in sliding engagement;

positioning means coupled to said second sub-frame and selectively operable to move said first sub-frame to predetermined positions along said guide rails in accordance with the transverse dimension of the rear portion of an electrical connector;

connector support means carried on said second sub-frame including spring means for receiving the forward end of a connector and urging the connector away from said support means;

a pair of conductor separation combs resiliently mounted on respective ones of said sub-frames and urged toward each other, each of said combs comprising a plurality of conductor receiving slots each having a cutting edge, and an edge for engaging a corresponding side of a supported connector in an interference relationship adjacent the insulation-piercing contact portions to releasably retain a connector against the force of said spring means and define a reference plane for connectors terminated with the apparatus;

a pair of pivotally mounted levers for moving said combs apart against the resilient mounting thereof to receive and remove a connector;

a pair of insertion arms rotatably mounted on respective ones of said sub-frames, each of said insertion arms including a plurality of insertion blades for pressing conductors into respective insulation-piercing contact portions, each of said blades including a cutting edge cooperable with the cutting edge of a corresponding comb slot to sever the conductor in the slot immediately prior to insertion;

a pair of spring loaded balls mounted on respective ones of said sub-frames adjacent the respective axes of rotation of said insertion arms to urge said arms perpendicular to their planes of rotation and toward said combs;

a pair of studs projecting from respective ones of said frames at an angle inclined toward each other; and a pair of toggle arms rotatably mounted at the distal ends of respective ones of said insertion arms, each of said toggle arms including a surface disposed at an angle to engage and complement that of respective ones of said studs and to be cammed perpendicularly to the planes of rotation of said insertion arms and toward said combs as said toggle arms are rotated toward each other.

6. Apparatus according to claim 5, wherein said spring means of said connector support means comprises an undulating blade spring.

7. Apparatus for terminating a plurality of free-ended insulated conductors in respective insulation-piercing portions of contacts mounted on opposite sides of the rear portion of an electrical connector, comprising:

a frame;

connector support means carried on said frame including spring means for receiving the forward end of a connector and urging the connector away from said support means;

a pair of conductor separation combs resiliently mounted on said frame and urged toward each other, each of said combs comprising a plurality of conductor receiving slots each having a cutting edge, and an edge for engaging a corresponding side of a supported connector in an interference relationship adjacent the insulation-piercing contact portions to releasably retain a connector against the force of said spring means and define a reference plane for connectors terminated with the apparatus;

a pair of pivotally mounted levers for moving said combs apart against the resilient mounting to receive and remove the connectors;

a pair of insertion arms rotatably mounted on said frame for rotation toward opposite sides of said connector support means, each of said insertion arms including a plurality of insertion blades for pressing conductors into respective insulation-piercing contact portions, each of said blades including a cutting edge cooperable with the cutting edge of a corresponding comb slot to sever the conductor in the slot immediately prior to insertion;

a pair of spring loaded balls mounted on said frame adjacent respective axes of rotation of said insertion arms to urge said arms perpendicular to their planes of rotation and toward said combs;

a pair of studs projecting from said frame at an angle inclined toward each other;

a pair of toggle arms rotatably mounted at the distal ends of respective ones of said insertion arms, each of said toggle arms including a surface disposed at an angle to engage and complement that of respective ones of said studs to be cammed perpendicularly to the planes of rotation of said insertion arms and toward said combs as said toggle arms are rotated toward each other; and positioning means including an eccentric mechanism rotatably mounting one of said insertion arms on said frame and operated to move the axis of rotation thereof in accordance with the transverse dimension of the rear portion of an electrical connector.

8. Apparatus for terminating a plurality of insulated conductors in respective contact portions of contacts supported by an electrical connector, comprising:

connector support means for holding an electrical connector, said connector support means comprising movably mounted first means including a pair of cutting members on opposite sides of said connector support means for releasably engaging the connector immediately adjacent the contact portions, each of said cutting members having a cutting edge, and second means urging the connector into engagement with said cutting members to establish a reference plane through the connector at the point of engagement of the connector and said cutting members;

a pair of arms mounted for movement toward respective sides of the supported connector, each of said arms carrying a plurality of insertion blades for engaging and pressing individual conductors into respective contact portions, each of said insertion blades including a cutting edge which is cooperable with a cutting edge of a respective cutting member to sever a corresponding conductor immediately prior to insertion into the respective contact portions; and means urging said arms perpendicularly with respect to their directions of movement to urge said cutting edges of said insertion blades toward said cutting edges of said cutting members.

9. Apparatus for terminating a plurality of insulated conductors in respective contact portions of contacts supported by a base portion of an electrical connector, the base portion varying in width from one connector to another, comprising:

connector support means for supporting an electrical connector;

first and second connector holding means each including a cutting member having a cutting edge, said cutting members mounted on opposite sides of said connector support means for movement toward and away from each other to engage a supported connector, and third means operable to position said first and second holding means in spaced relation in accordance with the width of the base portion of the supported connector;

a pair of arms mounted for movement toward respective sides of the supported connector, each of said arms carrying a plurality of insertion blades for engaging and pressing individual conductors into respective contact portions, each of said insertion blades including a cutting edge which is cooperable with a cutting edge of a respective cutting member to sever a corresponding conductor immediately prior to insertion into the respective contact portions; and means urging said arms perpendicularly with respect to their directions of movement to urge said cutting edges of said insertion blades toward said cutting edges of said cutting members.

10. Apparatus for terminating a plurality of insulated electrical conductors in respective contact portions of contacts which are supported on opposite sides of an electrical connector, comprising: connector support means for supporting an electrical connector;

a pair of cutting members on opposite sides of said connector support means, each of said cutting members having a cutting edge;

a pair of arms mounted for movement toward respective sides of the supported connector, each of said arms carrying a plurality of insertion blades for engaging and pressing individual conductors into respective contact portions, each of said insertion blades including a cutting edge which is cooperable with a cutting edge of a respective cutting member to sever a corresponding conductor immediately prior to insertion into the respective contact portions;

means urging said arms perpendicularly with respect to their directions of movement to urge said cutting edges of said insertion blades toward said cutting edges of said cutting members; and positioning means for adjusting the relative positions of said connector support means and said arms in accordance with the transverse width of the connector.

11. Apparatus for terminating a plurality of insulated electrical conductors in respective contact portions of contacts supported on opposite sides of an electrical connector, comprising:

connector support means for supporting an electrical connector for transverse movement;

a pair of cutting members on opposite sides of said connector support means, each of said cutting members having a cutting edge;

a pair of conductor installation arms mounted for movement toward respective sides of a supported connector, each of said arms including at least one conductor installation blade for engaging and pressing individual conductors into respective contact portions, each of said installation blades including a cutting edge which is cooperable with a cutting edge of a respective cutting member to sever a corresponding conductor immediately prior to installation into the respective contact portions;

means urging said conductor installation arms perpendicularly with respect to their directions of movement to urge said cutting edges of said installation blades toward said cutting edges of said cutting members; and adjustable means mounting said installation blade of at least one of said arms in predetermined positions with respect to the transverse dimension of the connector to define the depth of conductor installation.

12. Apparatus for electrically connecting a plurality of insulated conductors to respective insulation-piercing contact portions supported by an electrical connector, comprising:

a frame;

connector support means connected to said frame for supporting an electrical connector with the insulation-piercing contact portions oriented in a first direction;

a comb structure connected to said frame including means defining a plurality of slots, each of said slots aligned with and adjacent a respective contact portion and opening in a direction away from the supported connector to receive a conductor therein and including a cutting edge adjacent the connector;

an insertion arm rotatably connected to said frame for rotation in a second direction generally perpendicular to said first direction;

a plurality of insertion blades carried on said insertion arm for engaging and pressing the conductors into engagement with respective insulation-piercing contact portions, each said insertion blade including a cutting edge cooperable with a corresponding cutting edge of said comb structure to sever the respective conductor immediately prior to insertion, said frame including a fulcrum member; and a lever rotatably connected to said insertion arm for rotational movement, said lever including a portion for engaging said fulcrum member and applying a force to said insertion arm to sever and insert the conductors upon the application of a force to said lever.

13. Apparatus for electrically connecting a plurality of insulated conductors to respective insulation-piercing contact portions supported on opposite sides by an electrical connector, comprising:

a frame;

connector support means mounted on said frame for supporting an electrical connector with the insulation-piercing contact portions oriented to receive respective conductors;

a pair of combs connected to said frame on opposite sides of said connector support means, each of said combs including means defining a plurality of slots, each of said slots aligned with and adjacent a respective contact portion and opening in a direction away from the supported connector to receive a conductor therein and including a cutting edge adjacent the connector;

a pair of insertion arms, each of said insertion arms rotatably connected to said frame for rotation toward and away from a respective side of a supported connector;

a pair of insertion tools, each of said insertion tools carried on a respective insertion arm and including a plurality of insertion blades for engaging and pressing the conductors into engagement with respective insulation-piercing contact portions on the respective side of the supported connector, each of said insertion blades including a cutting edge cooperable with a corresponding cutting edge of a respective one of said combs to sever the respective conductor immediately prior to insertion;

fulcrum means connected to said frame; and a pair of levers, each of said levers rotatably connected to a respective insertion arm for rotary movement, each of said levers including a portion for engaging said fulcrum means and applying a force to the corresponding insertion arm to sever and insert the conductors upon the application of a force to said lever.

14. The apparatus of claim 13, wherein each of said combs is resiliently mounted on a respective side of said frame and urged toward each other to engage the supported connector.

15. The apparatus of claim 14, comprising means for moving said combs apart against the resilient mounting thereof to receive and remove an electrical connector.

16. The apparatus of claim 15 wherein said means for moving said combs includes a pair of levers pivotally mounted to said frame, each of said levers having a first end in engagement with a respective comb and a second end serving as a handle for moving the respective comb against the resilient mounting thereof.

17. In a conductor terminating apparatus of the type wherein insulated conductors are electrically and mechanically connected to respective contact portions of an electrical connector, the conductors being draped over a first cutting member which cooperates with the cutting edges of the second cutting member carried on a rotatably mounted lever for cutting the conductors with a scissor action, the improvement comprising:

means urging the lever in a direction perpendicular to its direction of rotation and in the direction of the first cutting member during a cutting operation to prevent parting of the cutting members, said means comprising a cam surface carried on the lever and a fixed cam mounted on the apparatus to engage said cam surface and force the lever toward the first cutting member.

18. The improvement in a conductor terminating apparatus according to claim 17, wherein said urging means further comprises a spring loaded ball bearing on the lever at a point spaced from said cam surface and said fixed cam.

19. In a conductor terminating apparatus of the type wherein insulated conductors are electrically and mechanically connected to respective contact portions of an electrical connector, the conductors being draped over a first cutting member which cooperates with the cutting edges of the second cutting member carried on a rotatably mounted lever for cutting the conductors with a scissor action, the improvement comprising:

means urging the lever in a direction perpendicular to its direction of rotation and in the direction of the first cutting member during a cutting operation to prevent parting of the cutting members, said means comprising a cam mounted on the apparatus to slidably interfere with and urge the lever toward the first cutting member.

20. The improvement in a conductor terminating apparatus according to claim 19, wherein said means comprises a spring loaded ball bearing on the lever at a point spaced from the point of slidable interference between said cam and said insertion lever.

* * * * *